US007764897B2

(12) United States Patent
Takezawa

(10) Patent No.: US 7,764,897 B2
(45) Date of Patent: Jul. 27, 2010

(54) COLOR IMAGE FORMING APPARATUS AND CONTROL METHOD THEREFOR

(75) Inventor: Satoru Takezawa, Nagareyama (JP)

(73) Assignee: Canon Kabushiki Kaisha (JP)

( * ) Notice: Subject to any disclaimer, the term of this patent is extended or adjusted under 35 U.S.C. 154(b) by 187 days.

(21) Appl. No.: 12/100,311

(22) Filed: Apr. 9, 2008

(65) Prior Publication Data

US 2008/0253781 A1 Oct. 16, 2008

(30) Foreign Application Priority Data

Apr. 10, 2007 (JP) ..... 2007-102922

(51) Int. Cl.
*G03G 15/00* (2006.01)
*G03G 15/01* (2006.01)

(52) U.S. Cl. ..... 399/72; 399/301; 399/372

(58) Field of Classification Search ..... 399/72, 399/301, 372
See application file for complete search history.

(56) References Cited

U.S. PATENT DOCUMENTS 7,212,226 B2 * 5/2007 Tanaka ..... 347/253
2004/0114964 A1 * 6/2004 Kitazawa et al. ..... 399/237
2006/0275057 A1 * 12/2006 Suzuki ..... 399/301
2007/0242966 A1 * 10/2007 Itagaki et al. ..... 399/49
2008/0181646 A1 * 7/2008 Yamada ..... 399/72

FOREIGN PATENT DOCUMENTS

JP 6-18796 A 1/1994
JP 6-118735 A 4/1994
JP 2004-109682 A 4/2004

* cited by examiner

*Primary Examiner*—David M Gray
*Assistant Examiner*—Rodney Bonnette
(74) *Attorney, Agent, or Firm*—Rossi, Kimms & McDowell LLP

(57) ABSTRACT

A color image forming apparatus which is capable of performing color misregistration correction, and registration of images and a recording sheet while reducing the toner consumption amount. An image forming section is caused to form a first reference image having a first density for adjusting a density of an adjusting image, and a second reference image having a second density different from the first density. A sensor detects the first reference image and the second reference image. The first density is determined as a density of the adjusting image, if an output signal level of the sensor at a time of detection of the first reference image is not lower than a predetermined value, and the output signal level of the sensor at a time of detection of the second reference image is lower than the predetermined value.

12 Claims, 7 Drawing Sheets

OUTPUT SIGNAL WAVEFORM
: ANALOG

OUTPUT SIGNAL WAVEFORM
: DIGITAL

COLOR IMAGE FORMING APPARATUS AND CONTROL METHOD THEREFOR

BACKGROUND OF THE INVENTION

1. Field of the Invention

The present invention relates to a color image forming apparatus that forms a color image using an electrophotographic method, and a control method therefor.

2. Description of the Related Art

Recently, image forming apparatus, such as copying machines printers, are demanded to form high-quality images, at high speed with high accuracy. Particularly, for color image forming apparatuses, as a means for increasing the speed, there have been employed, for example, a tandem method in which for a plurality of colors (the four colors of yellow, magenta, cyan, and black), respective image forming units are provided for sequential image forming operations. Each image forming unit performs image formation by an electrophotographic process including electrostatic charging, exposure, development of an image, and transfer of the image to a sheet.

The tandem-type color image forming apparatus is advantageous in that it can attain high printing speed, but is disadvantageous in that it is difficult to reduce color misregistration when superposing a plurality of color images one upon another. Even if the color misregistration correction is carried out immediately after the image forming apparatus is installed, misregistration is produced as time elapses, and even if the color misregistration correction is carried out immediately before the image forming apparatus is used, subtle displacement occurs due to a change in temperature. Such displacement causes color misregistration in a color image formed by superposition of color images.

To solve the problem, there have recently been proposed lots of techniques for preventing such color misregistration. For example, a position-detecting patch is formed on a transfer belt for detecting color misregistration, and the patch is detected by a CCD line sensor to thereby detect color misregistration of each color (see e.g. Japanese Patent Laid-Open Publication No. H06-18796). Further, two or more position-detecting patches are detected by optical sensors to thereby detect color misregistration of each color (see e.g. Japanese Patent Laid-Open Publication No. H06-118735).

The means for detection of position-detecting patches to correct color misregistration executes the detection every certain (predetermined) number of sheets or at certain (predetermined) time intervals, and position detecting data obtained by reading the patches of all the colors are averaged for use in color misregistration correction. The position-detecting patches are basically formed by patches with maximum densities, and if the large number of patches are required, larger amounts of toners (developing agents) are consumed, and further, an increased burden is laid on cleaning members for collecting the toners since an image of the patches is not transferred to a sheet.

Now, a technique has been proposed which uses density sensors for detecting toner densities also as position-detecting sensors for detecting color misregistration, with a view to reducing the amount of toner consumed for color misregistration correction (see e.g. Japanese Patent Laid-Open Publication No. 2004-109682).

However, the proposed technique of using the density sensors for detecting toner densities also as the position-detecting sensors for detecting color misregistration suffers from the problem that the density sensors cannot provide sufficient accuracy in detecting color misregistration.

SUMMARY OF THE INVENTION

The present invention provides a color image forming apparatus which is capable of performing color misregistration correction, and registration of images and a recording sheet while reducing the toner consumption amount.

In a first aspect of the present the present invention, there is provided an image forming apparatus comprising an image forming section configured to form an image on an image bearing member, a control section configured to cause the image forming section to form an adjusting image on the image bearing member, and a sensor configured to detect the adjusting image, wherein the control section controls a position where the image is formed, based on the result of detection by the sensor, and wherein the control section causes the image forming section to form a first reference image having a first density for adjusting a density of the adjusting image, and a second reference image having a second density different from the first density, causes the sensor to detect the first reference image and the second reference image, and determines the first density as a density of the adjusting image, if an output signal level of the sensor at a time of detection of the first reference image is not lower than a predetermined value, and the output signal level of the sensor at a time of detection of the second reference image is lower than the predetermined value.

According to the color image forming apparatus according to the first aspect of the present invention, the control section causes the image forming section to form an adjusting image on the image bearing member. The sensor detects the adjusting image. The control section causes the image forming section to form a first reference image having a first density for adjusting a density of the adjusting image, and a second reference image having a second density different from the first density, causes the sensor to detect the first reference image and the second reference image, and determines the first density as a density of the adjusting image, if an output signal level of the sensor at a time of detection of the first reference image is not lower than a predetermined value, and the output signal level of the sensor at a time of detection of the second reference image is lower than the predetermined value.

With this arrangement, it is possible to perform color misregistration correction, and registration of images and a recording sheet while reducing the toner consumption amount.

If the output signal level of the sensor at the time of detection of the first reference image is not lower than the predetermined value, and the output level of the sensor at the time of detection of the second reference image is also not lower than the predetermined value, the control section can cause the image forming section to form a third reference image having a third density lower than the first density and the second density.

If the output signal level of the sensor at the time of detection of the first reference image is lower than the predetermined value, and the output level of the sensor at the time of detection of the second reference image is also lower than the predetermined value, the control section can cause the image forming section to form a third reference image having a third density higher than the first density and the second density.

The control section can cause the image forming section to form the adjusting image at the determined density, and can control a position where the image is to be formed, based on the result of detection of the sensor.

In a second aspect of the present invention, there is provided a color image forming apparatus comprising an image forming section configured to form an image on an image bearing member, a control section configured to cause the image forming section to form an adjusting image on the image bearing member, and a sensor configured to detect the adjusting image, wherein the control section controls a position where the image is formed, based on the result of detection by the sensor, and wherein the control section causes the image forming section to form a plurality of different reference images having respective different densities for use in adjusting a density of the adjusting image, causes the sensor to detect the reference images, and determine a density corresponding to an output signal level of the sensor which is higher than a predetermined value, and at the same time closest to the predetermined value, as the density of the adjusting image.

The control section can cause the image forming section to form the adjusting image at the determined density, and controls a position where the image is to be formed, based on the result of detection of the sensor.

In a third aspect of the present invention, there is provided a method of controlling an image forming apparatus including an image forming section configured to form an image on an image bearing member, a control section configured to cause the image forming section to form an adjusting image on the image bearing member, and a sensor configured to detect the adjusting image, wherein the control section controls a position where the image is formed, based on the result of detection by the sensor, comprising reference image-forming step of forming a first reference image having a first density for adjusting a density of the adjusting image, and a second reference image having a second density different from the first density, a detection step of detecting the first reference image and the second reference image, and a determining step of determining the first density as a density of the adjusting image, if an output signal level of the sensor at a time of detection of the first reference image is not lower than a predetermined value, and the output signal level of the sensor at a time of detection of the second reference image is lower than the predetermined value.

In a fourth aspect of the present invention, there is provided a method of controlling an image forming apparatus including an image forming section configured to form an image on an image bearing member, a control section configured to cause the image forming section to form an adjusting image on the image bearing member, and a sensor configured to detect the adjusting image, wherein the control section controls a position where the image is formed, based on the result of detection by the sensor, comprising a reference image-forming step of forming a plurality of different reference images having respective different densities for use in adjusting a density of the adjusting image, a detection step of detecting the reference images, and a determining step of determining a density corresponding to an output signal level of the sensor which is higher than a predetermined value, and at the same time closest to the predetermined value, as the density of the adjusting image.

The features and advantages of the invention will become more apparent from the following detailed description taken in conjunction with the accompanying drawings.

DETAILED DESCRIPTION OF THE EMBODIMENTS

The present invention will now be described in detail with reference to the drawings showing preferred embodiments thereof.

Figure 1:
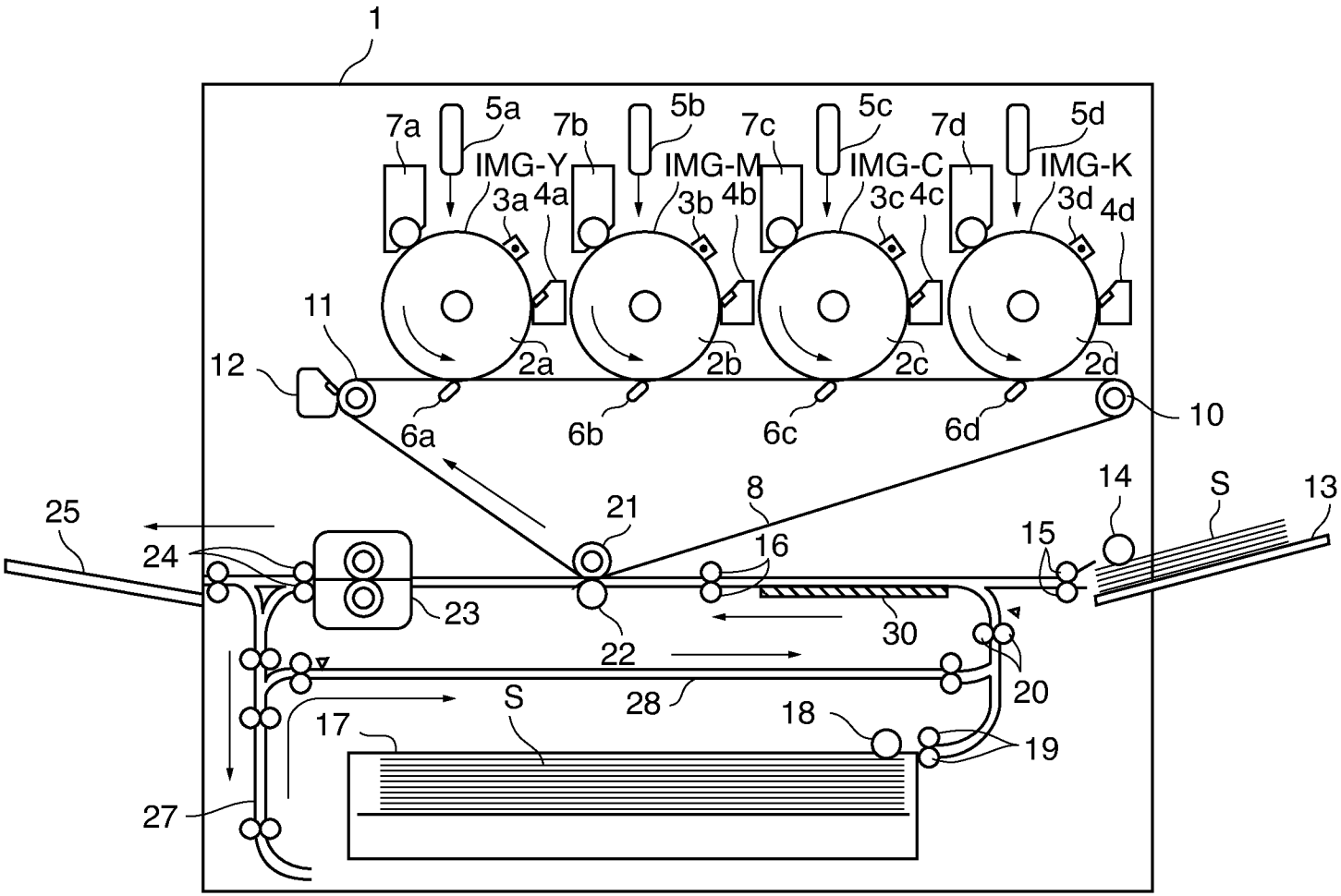
FIG. 1 is a view of the whole arrangement of a color image forming apparatus according to an embodiment of the present invention.

FIG. 1 is a view of the whole arrangement of a color image forming apparatus according to an embodiment of the present invention.

In FIG. 1, an apparatus main unit 1 of the image forming apparatus includes image forming units IMG-Y, IMG-M, IMG-C, and IMG-K for a plurality of colors (the four colors of yellow, magenta, cyan, and black). Each of the image forming units IMG-Y, IMG-M, IMG-C, and IMG-K has photosensitive drums 2*a* to 2*d* as image bearing members, and around the photosensitive drums 2*a* to 2*d*, there are arranged electrostatic chargers 3*a* to 3*d*, cleaners 4*a* to 4*d*, laser scanning units 5*a* to 5*d*, transfer blades 6*a* to 6*d*, and developing units 7*a* to 7*d*, in a manner opposed to the respective outer peripheral surfaces thereof.

Below the image forming units, there extends an intermediate transfer belt 8 whose upper surface is flat and is in contact with the photosensitive drums 2*a* to 2*d*. The intermediate transfer belt 8 is supported by rollers 10 and 11, and a cleaner 12 is in contact with the intermediate transfer belt 8. The image forming apparatus including four image forming units provided on the horizontal surface of the intermediate transfer belt 8 is called a tandem type.

Further, the apparatus main unit 1 includes a manual feed tray 13 for receiving recording sheets S therein, pickup rollers 14 and 15 therefor, registration rollers 16, sheet feed cassettes 17 for receiving recording sheets S therein, pickup rollers 18 and 19 therefor, vertical path rollers 20, and a rotation roller 21. Further, the apparatus main unit 1 includes a secondary transfer roller 22, a fixing unit 23, discharge rollers 24, a discharge tray 25, a double-sided inverting path 27, and a double-sided path 28. In the color image forming apparatus constructed above, on the photosensitive drums 2*a* to 2*d* of the respective colors, static latent images are formed by respective laser scanning units 5*a* to 5*d* using semiconductor lasers as light sources, and the static latent images are developed by the respective developing units 7*a* to 7*d*.

Then, the toner images of the respective colors developed on the photosensitive drums 2*a* to 2*d* are formed as a four-color toner image on the intermediate transfer belt 8, and are collectively transferred to the recording sheet S by the secondary transfer roller 22. The recording sheet then passes through the fixing unit 23 whereby the toners are melted to form a permanent image.

On the other hand, the recording sheet S is fed from the sheet feed cassette 17 or the manual feed tray 13, and has its lateral registration position corrected by an electrostatic conveying unit 30. Then, the recording sheet S is conveyed to the secondary transfer roller 22 while making the registration timing synchronous by the registration rollers 16.

At this time, the recording sheet conveying-component parts, such as the pickup rollers 18 and 19, the vertical path rollers 20, the registration rollers 16, and the pickup rollers 14 and 15 are driven by stepping motors independently of each other, so as to realize a high-speed stable conveying operation.

Further, when performing double-sided printing, the recording sheet S having passed through the fixing unit 23 and the registration rollers 24 is guided to the double-sided inverting path 27, wherein it is inverted and conveyed in an opposite direction into the double-sided path 28. After passing through the double-sided path, the recording sheet S passes through the vertical path rollers 20 again, and similarly to a first-side image already formed, a second-side image is formed and transferred to the recording sheet S. Then, after having the second-side image fixed thereto, the recording sheet S is discharged.

Figure 2:
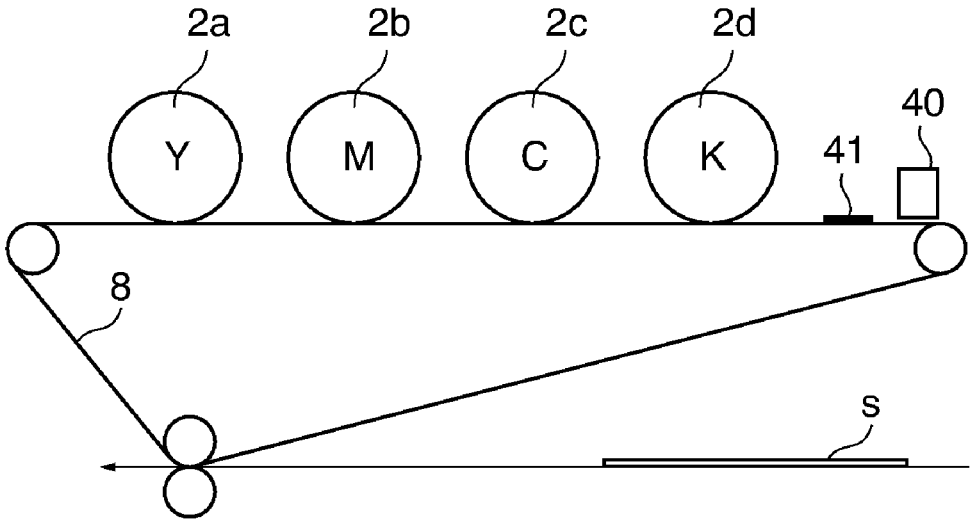
FIG. 2 is a schematic diagram showing an example of a position-detecting patch formed on an intermediate transfer belt of the color image forming apparatus in FIG. 1.

FIG. 2 is a schematic diagram showing an example of a position-detecting patch formed on the intermediate transfer belt of the color image forming apparatus in FIG. 1.

In the tandem-type color image forming apparatus, as described hereinabove, a plurality of toner images of yellow, magenta, cyan, and black formed on the respective photosensitive drums 2*a* to 2*d* are sequentially transferred onto the intermediate transfer belt 8 in an superimposed manner. The toner images of yellow, magenta, cyan, and black transferred in a superimposed manner are finally collectively transferred onto the recording sheet S to thereby form a color image on the recording sheet S.

Color patches of the position-detecting patch 41 for color registration are formed by stations (image forming units) for the colors, and are transferred to the intermediate transfer belt 8, and the position-detecting patch 41 thus formed is read by a first patch sensor 40.

Figure 3:
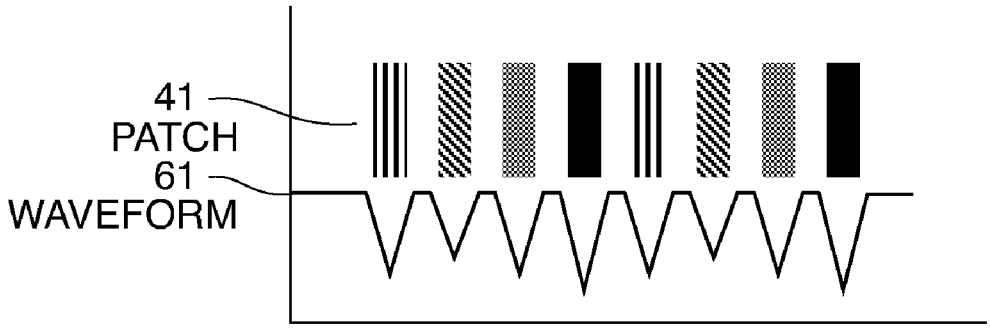
FIG. 3 is a diagram showing a position-detecting patch and the waveform of an output voltage from a first patch sensor which indicates the detected position-detecting patch.
Figure 4:
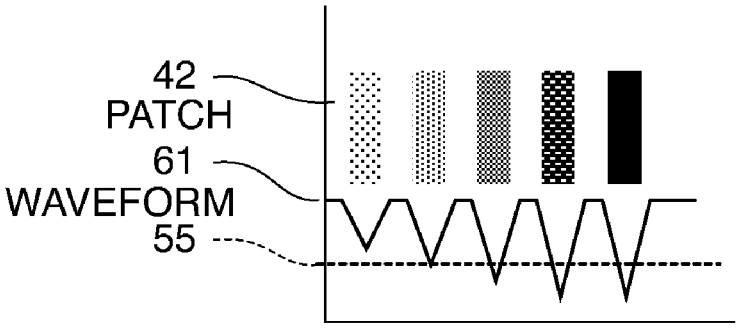
FIG. 4 is a diagram showing an image leading edge-detecting patch, and the relationship between the waveform of an output voltage from a second patch sensor which indicates the detected image leading edge-detecting patch.

FIG. 3 is a diagram showing a position-detecting patch and the waveform of an output voltage (output signal) (analog) from the first patch sensor 40 which indicates the detected position-detecting patch. FIG. 4 is a diagram showing an image leading edge-detecting patch, and the relationship between the waveform of an output voltage (output signal) from a second patch sensor 44 which indicates the detected image leading edge-detecting patch and a reference value. These figures will be referred to hereinafter.

Figure 5A:
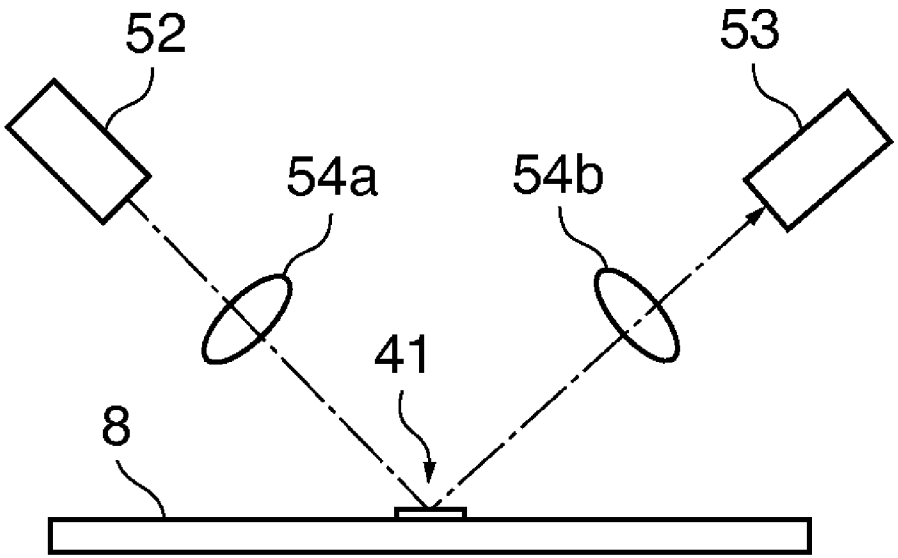
FIG. 5 is a diagram of the arrangement of the first patch sensor appearing in FIG. 2.
Figure 5B:
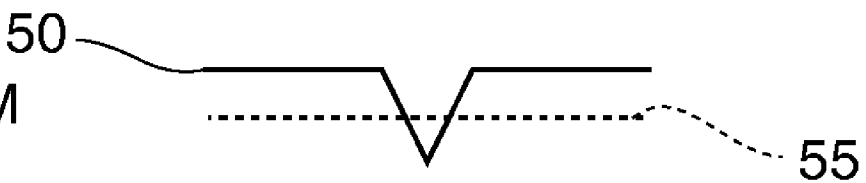
Figure 5C:
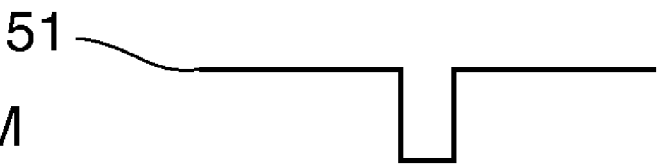

FIG. 5 is a diagram showing the arrangement of the first patch sensor 40 appearing in FIG. 2.

As shown in FIG. 5, the first patch sensor 40 has a light emitting section and a light receiving section 53. Light emitted from the light emitting section 52 hits the intermediate transfer belt 8 and the position-detecting patch 41, and light reflected therefrom enters the light receiving section 53, where the light is subjected to photoelectric conversion, which gives an output voltage commensurate with the amount of the light. Lenses 54*a* and 54*b* are disposed respectively between the light emitting section 52 and the light receiving section 53 and an object to be detected, such as the intermediate transfer belt 8. The lens 54*a* causes the light emitted from the light emitting section 52 to converge, while the lens 54*b* causes the reflected light to be efficiently received by the light receiving section 53.

The first patch sensor 40 is configured to be capable of adjusting the amount of light, based on the output voltage of the light receiving section 53 that receives the light reflected from the background of the intermediate transfer belt 8, such that a certain appropriate output voltage is obtained. To cope with an unintended variation in the amount of light, the first patch sensor 40 changes the amount of light emitted therefrom to thereby adjust the amount of emitted light such that the output voltage thereof becomes equal to a predetermined value.

The adjustment of the amount of light is generally executed under the condition of no position-detecting patch 41 being formed on the intermediate transfer belt 8, i.e. using the base of the intermediate transfer belt 8. The waveform of an output signal (analog) 50 occurring when the position-detecting patch 41 is read after adjustment of the amount of light becomes e.g. as shown in FIG. 5.

The output voltage (output signal waveform 50) of the base of the intermediate transfer belt is configured to be equal to a certain predetermined value (e.g. 5V) after adjustment of the amount of light. In the case of the first patch sensor 40 of a regular reflection type, the output voltage thereof upon detection of the position-detecting patch 41 becomes lower than the output voltage upon detection of the base of the intermediate transfer belt 8, and the output voltage and a threshold value (reference value) 55 with reference to which the output voltage can be normally converted into a digital signal are adjusted such that the former become equal to or lower than the latter upon detection of the position-detecting patch 41.

The baycener of a rise and a fall of the resulting digitized output signal waveform 51 is determined, and is used as position detecting data of the position-detecting patch 41. The sensor output (waveform 61) upon detection of the yellow, magenta, cyan, and black color patches of the position-detecting patch 41 formed by the respective stations are as shown in FIG. 3. The respective reflectance coefficients of yellow, magenta, cyan and black toners are different therebetween, and hence the output voltages for the respective color patches are different from each other. This is because the reflectance coefficient varies with the color and density of the toner. It should be noted that the second patch sensor 44 also has the same arrangement as that of the first patch sensor 41.

In the present embodiment, the density of the position-detecting patch 41 is adjusted for color misregistration correction. Before that, first, the amount of light is adjusted using the base of the intermediate transfer belt 8 while conveying the transfer belt 8. Then, after the output voltage becomes equal to the predetermined value, the amount of light is kept fixed until the amount of light is adjusted next time. The timing for the adjustment of the amount of light may be set to each time point when the apparatus is started up or to each time point when the number of printed sheets has reached a predetermined value.

Next, the density adjustment of the position-detecting patch 41 is carried out. Color patches formed by the respective stations (image forming units) are transferred to the intermediate transfer belt 8 to form the position-detecting patch 41. The patch densities are provided in a plurality of levels ranging from a lowest density to a highest density.

Figure 6:
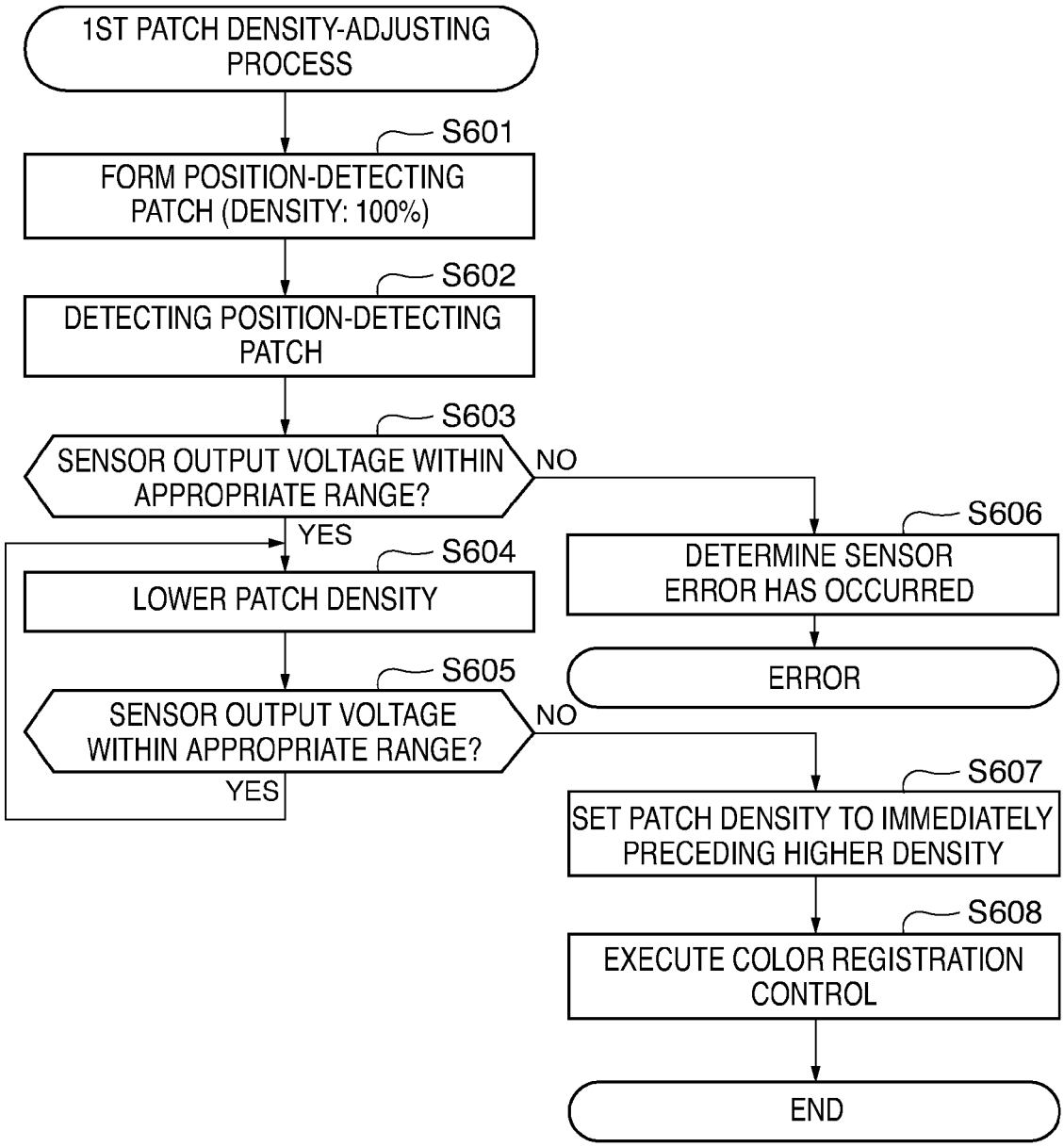
FIG. 6 is a flowchart of a first patch density-adjusting process executed by the color image forming apparatus shown in FIG. 1.

FIG. 6 is a flowchart of a first patch density-adjusting process executed by the color image forming apparatus shown in FIG. 2.

As shown in FIG. 6, first, a position-detecting patch (hereinafter also simply referred to as "the patch") 41 at a toner density of 100% is formed (step S601), and the first patch sensor 40 reads (sequentially detect) the color patches of the patch 41 (step S602).

It is determined whether or not the output voltage of the first patch sensor 40 has reached a predetermined value (step S603). If the patch-reading voltage has not reached the predetermined value, it is determined that a sensor error has occurred (step S606). As a method of this determination, it is envisaged to employ a method of binarizing the analog signal using a comparator, and determining whether the binary data indicates a low value Lo.

If the output voltage has reached the predetermined value, the patch 41 with a toner density lowered by a predetermined percentage (e.g. a toner density of 90%) is formed and read (step S604). Then, it is determined whether or not the output voltage has reached the predetermined value (step S605).

If the output voltage has not reached the predetermined value, the patch having the density at the preceding level is set to the position-detecting patch 41. That is, the patch density is set to the immediately preceding higher density (step S607), and color registration detection control (color misregistration correction control) is executed (step S608), followed by terminating the present process. If the output voltage has reached the predetermined value, the patch with a toner density further lowered by a predetermined percentage is formed and read (step S604). This sequence of operations is repeatedly carried out to determine an appropriate patch density.

Figure 7:
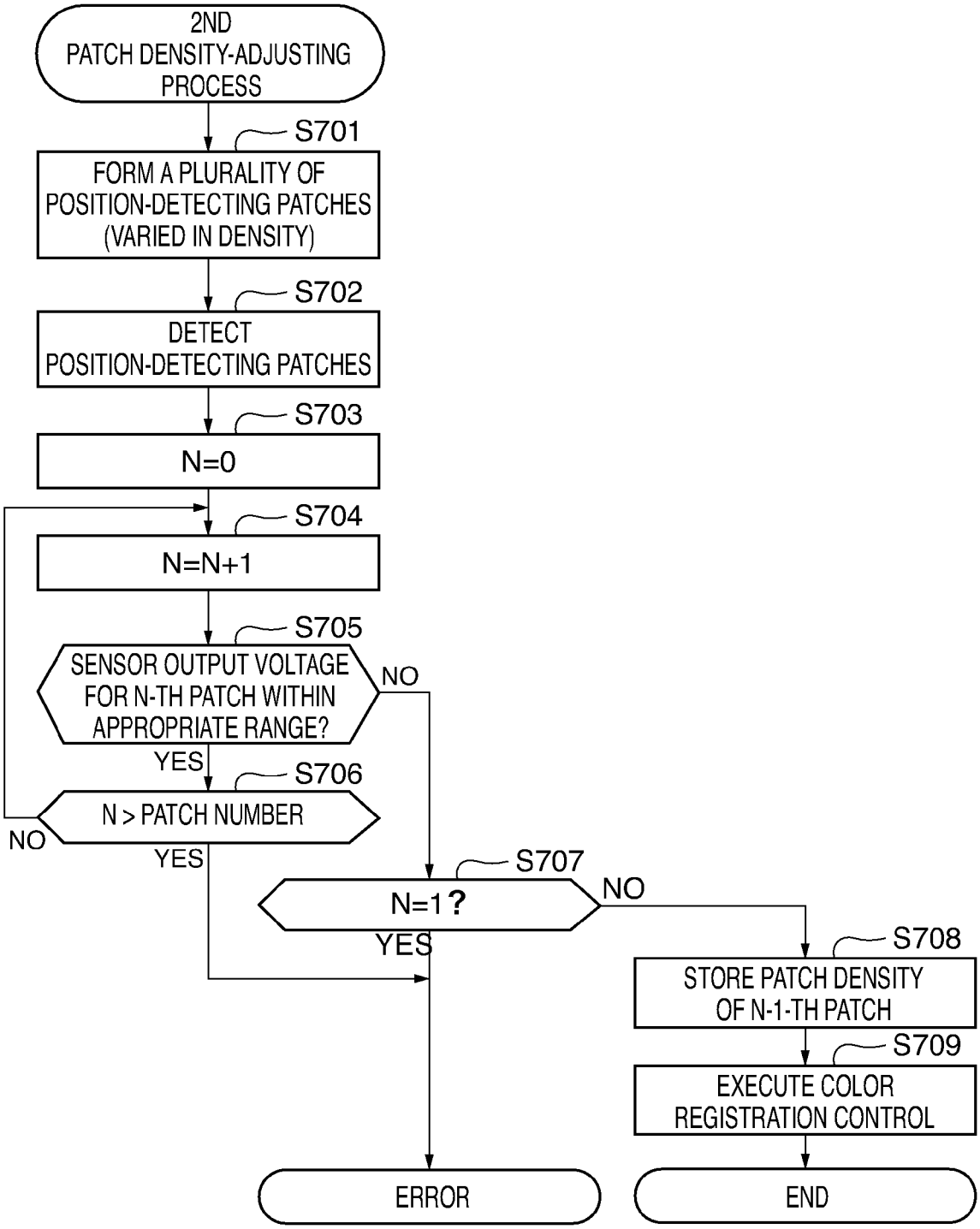
FIG. 7 is a flowchart of a second patch density-adjusting process executed by the color image forming apparatus shown in FIG. 1.

Although in the above-described method, one patch is formed for one density to determine whether the patch detection level shows an appropriate value, a plurality of patches with different densities may be formed, and the patches 41 with different densities are continuously read to sequentially determine on a density basis whether the output voltage gives an appropriate value, as described hereafter with reference to FIG. 7.

FIG. 7 is a flowchart of a second patch density-adjusting process executed by the color image-forming apparatus in FIG. 2.

As shown in FIG. 7, a plurality of patches with different densities are generated (step S701), and read (step S702). Insofar as the output voltage of the first patch sensor 40 has an appropriate value, a variable N indicative of the number of times of patch detection is incremented by 1 (steps S703 and S704), to determine whether or not the output voltage associated with an N-th number path has an appropriate value (step S705).

If the output voltage has an appropriate value, and the variable N indicative of the number of times of the patch detection is not larger than the number of the generated patches (NO to the step S706), the process returns to the step S704. If the variable N indicative of the number of times of the patch detection is larger than the number of the generated patches (YES to the step S706), it is judged that a sensor error has occurred, and a density selection sequence in which the densities of patches are different from those of the patches formed before is executed again, or an error message is displayed.

If the output voltage associated with the N-th patch does not have an appropriate value, it is determined whether or not N=1 holds (step S707). That is, it is determined whether or not the output voltage of the first patch sensor 40 delivered upon reading a patch having the highest density has an appropriate value. If the value read for the first time is not an appropriate value, i.e. if N=1 holds (YES to step S707), it is judged that a sensor error has occurred, whereas if N=1 does not hold, the density of the N-1-th patch is stored in a storage device (step S708). The color registration detection control is executed at this density (step S709), followed by terminating the present process.

It should be noted that in FIG. 6, the patches are generated starting with a patch with a density of 100% (density: 1.6), but they may be generated starting with a patch with a density of 1.4. In this case, it is possible to detect patch densities using a smaller number of generated patches than the number of patches generated in FIG. 6.

Further, the patches are sequentially generated in the order of decreasing densities, but they may be sequentially generated in the order of increasing densities, whereby not only the amount of toners consumed for executing color registration, but also the amount of toners consumed at a stage of determining a patch density can be reduced, and the burden on the cleaners can be lessened.

In this case as well, without generating patches starting with a density of 0.1, but by starting with a density, e.g. 0.8, which is close to a threshold where the value changes from outside an appropriate range into the appropriate range, to progressively increase the density, it is possible to detect patch densities by minimizing the number of generates patches. In this case, a value of the density which results in a shift from outside the appropriate range into the appropriate range, e.g. 1.0 is caused to be set to the density of the patch.

In the present embodiment, sensor error detection is performed using the patch formed first, if the patches are formed starting with a patch outside the appropriate density range, the first patch alone may be formed such that it necessary has a density within the appropriate range, and after confirming that a sensor error does not occur, the following patches may be formed as described above while changing the density in a direction from outside the appropriate range into the appropriate range, starting with a patch with a density lower than the appropriate values.

The sequence of reducing the toner consumption amount can be applied not only to the position-detecting patch 41, but also to the image leading edge-detecting patch 42 for use in leading edge registration control for registration between an image and the recording sheet.

Figure 8:
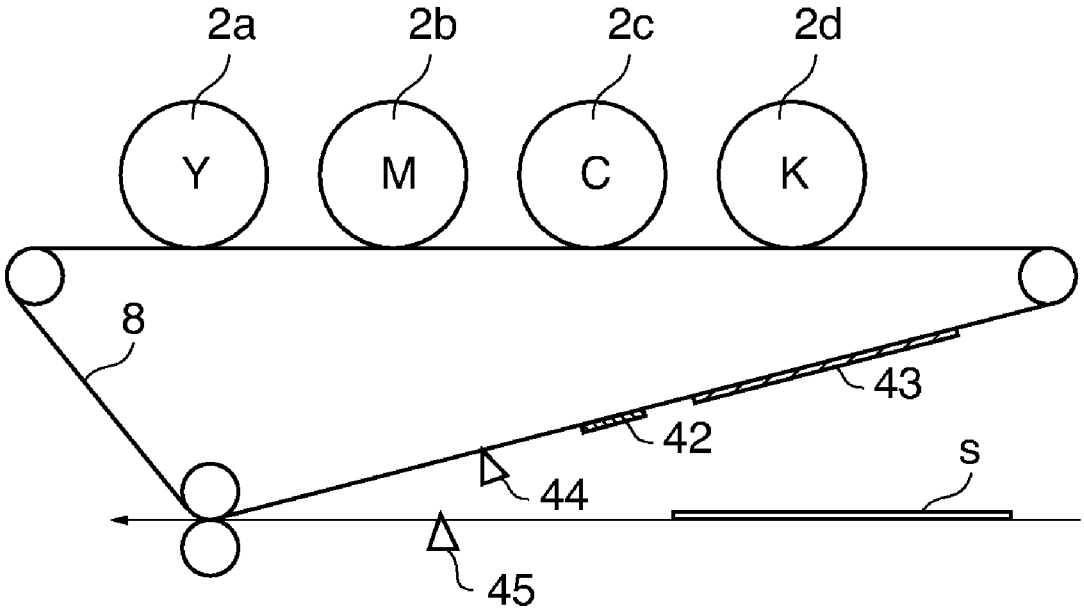
FIG. 8 is a schematic diagram showing an example of an image leading edge-detecting patch formed on the intermediate transfer belt of the color image forming apparatus in FIG. 1.

FIG. 8 is a schematic diagram showing an example of an image leading edge-detecting patch formed on the intermediate transfer belt of the color image forming apparatus in FIG. 1.

As shown in FIG. 8, the image leading edge-detecting patch 42 is formed on the intermediate transfer belt 8. The image leading edge-detecting patch 42 is formed at a position a predetermined distance forward of the image 43 to be transferred onto the recording sheet S. Further, the image leading edge-detecting patch 42 is generated outside the recording area of the recording sheet S.

Further, the second patch sensor 44 is disposed below the intermediate transfer belt 8 in a manner opposed thereto. Further, on the recording sheet conveying path, a sheet sensor 45 is disposed for detecting the recording sheet S.

As the intermediate transfer belt 8 rotates and the recording sheet S is conveyed, the image leading edge-detecting patch 42 is detected by the second patch sensor 44, and based on the timing of detection of the image leading edge by the second patch sensor 44 and the timing of detection of the recording sheet S by the sheet sensor 45, the conveying speed of the sheet S is varied to thereby cause the image leading edge and the leading edge of the recording sheet to register with each other.

Before executing this control, first, control is performed to cause the density of the image leading edge-detecting patch 42 (hereinafter also simply referred to as "the patch") to have an appropriate value. First, the second patch sensor 44 sequentially detects patches the density of which is uniformly varied between 100% and 10%, e.g. in a sequence of 100%, 90%, 80%, 70%, 60%, 50%, 40%, 30%, 20%, and 10%.

At this time, the output voltage of the second patch sensor 44 varies with the density of the patch as shown in FIG. 4. Through comparison of the output voltage of the second patch sensor 44 with a reference value, a patch exhibiting a density value which is second highest to the density value which has been the first to fall outside the appropriate range is used as the image leading edge-detecting patch 42.

In the sequence of adjusting the patch density is, as shown in FIG. 6, first, a patch having a density of 100% is formed. The second patch sensor 44 detects the patch, and it is determined whether or not the output voltage of the second patch sensor 44 at the time is within the appropriate range.

If the output voltage indicative of detection of the patch having a density of 100% is not within the appropriate range, it is determined that a sensor error has occurred, whereas if the same is within the appropriate range, a patch having a next lower density is formed. Then, the second patch sensor 44 detects the patch again, and the output voltage indicative of detection of the patch is compared with the appropriate range, and if the output voltage is outside the appropriate range, the patch density of the patch formed on the immediately preceding loop is used for leading edge registration control.

If the output voltage is within the appropriate range, a patch which is further lowered in toner density is formed. Thus, the patch density associated with the output voltage which is highest within the appropriate range is used for the leading edge registration control.

In the above-described sequence, the patch density is lowered whenever the second patch sensor 44 detects a patch density once, and hence it takes time to complete the patch density adjustment.

Therefore, as shown in FIG. 7, patches having densities of 100% to 10% may be sequentially formed with a certain amount of gap between each adjacent ones of them to form an image leading edge-detecting patch 42, and the image leading edge-detecting patch 42 may be detected (waveform 61), as shown in FIG. 4, for toner density adjustment.

More specifically, patches the density of which is uniformly varied between 100% to 10%, e.g. in a sequence of 100%, 90%, 80%, 70%, 60%, 50%, 40%, 30%, 20%, and 10%, with a certain amount of gap between each adjacent ones of them are formed sequentially at equal space intervals. Then, the patches are detected sequentially by the second patch sensor 44.

Then, as described hereinbefore with reference to FIG. 7, the number of times of reading each patch is recorded, and at the same time, it is determined whether or not the associated output voltage of the second patch sensor 44 is within an appropriate range. If the output voltage indicative of the density of a patch which is detected first is outside the appropriate range, it is determined that a sensor error has occurred. If the output voltage is within the appropriate range, it is determined whether or not the output voltage indicative of the density of a patch which is next lower than that of the first detected one is within the appropriate range. If the output voltage at this time is within the appropriate range, the output voltage indicative of the density of a patch which is further lower is checked. After all, a patch which is lowest in toner density on condition that the output voltage corresponding thereto is within the appropriate range is used as the image leading edge-detecting patch 42.

Although in the above-described embodiment, the patches are generated starting with a patch with a density of 100% (density: 1.6), but patches may be generated starting with a patch with a density of 1.4. In this case, it is possible to detect patch densities using an even smaller number of generated patches. Further, although the patches are sequentially generated in the order of decreasing densities, they may be sequentially generated in the order of increasing densities, whereby not only the amount of toners consumed for forming the image leading edge-detecting patches, but also the amount of toners consumed at a stage of determining a patch density can be reduced, and further the burden on the cleaners can be lessened.

In this case as well, without generating patches starting with a density of 0.1, but by starting with a density e.g. 1.4 close to a threshold where the value changes from outside an appropriate range into the appropriate range, to progressively increase the density, it is possible to detect patch densities by minimizing the number of generates patches. In this case, a value of the density which results in a shift from outside the appropriate range into the appropriate range, i.e. 1.0 is caused to be set to the density of a patch.

Figure 9:
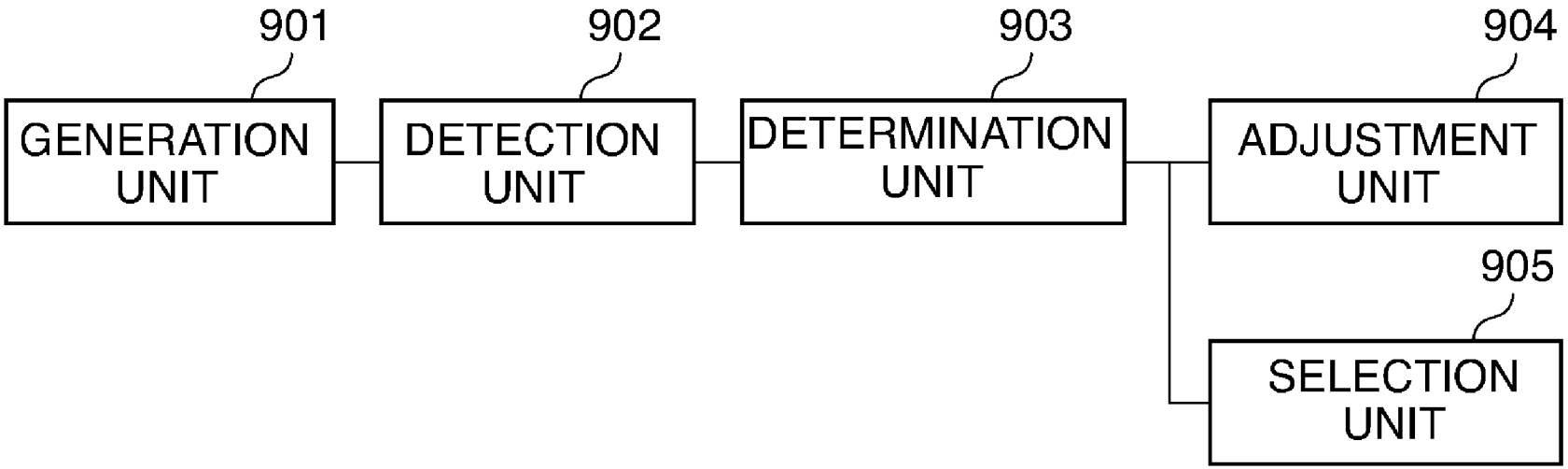
FIG. 9 is a schematic functional block diagram of the color image forming apparatus according to the present embodiment.

FIG. 9 is a functional block diagram of the color image forming apparatus according to the present embodiment.

As shown in FIG. 9, the color image forming apparatus is comprised of a generation unit 901 that generates a position-detecting patch, and a detection unit 902 that detects the position-detecting patch.

Further, the color image forming apparatus is also comprised of a determination unit 903 that determines whether or not the density of the position-detecting patch is within an appropriate range, an adjustment unit 904 that adjusts the density of the position-detecting patch, and a selection unit that selects the position-detecting patch. As for the adjustment unit 904 and the selection unit 905, only one of them may be provided.

As described heretofore, according to the present embodiment, by holding the densities of patches to the minimum, it is possible to reduce the toner consumption amount and lessen the burden on the cleaner 12 of the intermediate transfer belt 8. Particularly, the image leading edge-detecting patch 42 is formed on each recording sheet, and hence it is very effective in reducing the toner consumption amount.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions This application claims priority from Japanese Patent Application No. 2007-102922 filed Apr. 10, 2007, which is hereby incorporated by reference herein in its entirety.

What is claimed is:

1. An image forming apparatus comprising:

an image forming section configured to form an image on an image bearing member;

a control section configured to cause said image forming section to form an adjusting image on the image bearing member; and a sensor configured to detect the adjusting image, wherein said control section is configured to control color registration of the image based on the result of detection by said sensor, and wherein said control section, in order to control the color registration, is configured to: cause said image forming section to form a first reference image having a first density for adjusting a density of the adjusting image, and a second reference image having a second density different from the first density; cause said sensor to detect the first reference image and the second reference image; and determine the first density as a density of the adjusting image, if an output signal level of said sensor at a time of detection of the first reference image is not lower than a predetermined value, and the output signal level of said sensor at a time of detection of the second reference image is lower than the predetermined value.

2. A color image forming apparatus as claimed in claim 1, wherein if the output signal level of said sensor at the time of detection of the first reference image is not lower than the predetermined value, and the output signal level of said sensor at the time of detection of the second reference image is also not lower than the predetermined value, said control section is configured to cause said image forming section to form a third reference image having a third density lower than the first density and the second density.

3. A color image forming apparatus as claimed in claim 1, wherein if the output signal level of said sensor at the time of detection of the first reference image is lower than the predetermined value, and the output signal level of said sensor at the time of detection of the second reference image is also lower than the predetermined value, said control section is configured to cause said image forming section to form a third reference image having a third density higher than the first density and the second density.

4. A color image forming apparatus as claimed in claim 1, wherein said control section is configured to cause said image forming section to form the adjusting image at the determined density, and is configured to control the color registration of the image based on the result of detection of said sensor.

5. A color image forming apparatus comprising:

an image forming section configured to form an image on an image bearing member;

a control section configured to cause said image forming section to form an adjusting image on the image bearing member; and a sensor configured to detect the adjusting image, wherein said control section is configured to control color registration of the image based on the result of detection by said sensor, and wherein said control section, in order to control the color registration, is configured to: cause said image forming section to form a plurality of different reference images having respective different densities for use in adjusting a density of the adjusting image; cause said sensor to detect the reference images; and determine a density corresponding to an output signal level of said sensor based on the sensor's detecting of a particular one of the reference images, which is higher than a predetermined value, and at the same time closest to the predetermined value, as the density of the adjusting image.

6. A color image forming apparatus as claimed in claim 5, wherein said control section is configured to cause said image forming section to form the adjusting image at the determined density, and is configured to control the color registration of the image based on the result of detection of said sensor.

7. A method of controlling color registration of an image to be formed by an image forming apparatus, the apparatus including an image forming section configured to form the image on an image bearing member, a control section configured to cause the image forming section to form an adjusting image on the image bearing member, and a sensor configured to detect the adjusting image, wherein the control section is configured to control the color registration of the image based on the result of detection by the sensor, the method comprising:

a reference image-forming step of forming a first reference image having a first density for adjusting a density of the adjusting image, and a second reference image having a second density different from the first density;

a detection step of detecting the first reference image and the second reference image; and a determining step of determining the first density as a density of the adjusting image, if an output signal level of the sensor at a time of detection of the first reference image is not lower than a predetermined value, and the output signal level of the sensor at a time of detection of the second reference image is lower than the predetermined value.

8. A method as claimed in claim 7, wherein if the output signal level of the sensor at the time of detection of the first reference image is not lower than the predetermined value, and the output signal level of the sensor at the time of detection of the second reference image is also not lower than the predetermined value, the method further comprises the step of forming a third reference image having a third density lower than the first density and the second density.

9. A method as claimed in claim 7, wherein if the output signal level of the sensor at the time of detection of the first reference image is lower than the predetermined value, and the output signal level of the sensor at the time of detection of the second reference image is also lower than the predetermined value, the method further comprises the step of forming a third reference image having a third density higher than the first density and the second density.

10. A color image forming apparatus as claimed in claim 7, wherein the method further comprises the steps of: forming the adjusting image at the determined density; and controlling the color registration of the image based on the result of detection of the sensor.

11. A method of controlling color registration of an image to be formed by an image forming apparatus, the apparatus including an image forming section configured to form the image on an image bearing member, a control section configured to cause the image forming section to form an adjusting image on the image bearing member, and a sensor configured to detect the adjusting image, wherein the control section is configured to control the color registration of the image based on the result of detection by the sensor, the method comprising:

a reference image-forming step of forming a plurality of different reference images having respective different densities for use in adjusting a density of the adjusting image;

a detection step of detecting the reference images; and a determining step of determining a density corresponding to an output signal level of the sensor based on the sensor's detecting of a particular one of the reference images, which is higher than a predetermined value, and at the same time closest to the predetermined value, as the density of the adjusting image.

12. A method as claimed in claim 11, wherein the method further comprises the steps of: forming the adjusting image at the determined density; and controlling the color registration of the image based on the result of detection of the sensor.

* * * * *